US005665207A

United States Patent [19]

Aikawa

[11] Patent Number: 5,665,207

[45] Date of Patent: Sep. 9, 1997

[54] STRAINER FOR PAPER MAKING

[75] Inventor: Yoshihiko Aikawa, Shizuoka, Japan

[73] Assignee: Aikawa Iron Works Co., Ltd., Shiauoka-ken, Japan

[21] Appl. No.: 767,107

[22] Filed: Sep. 27, 1991

[30] Foreign Application Priority Data

Oct. 1, 1990 [JP] Japan ..... 2-102227 U

[51] Int. Cl.[6] ..... D21D 5/02

[52] U.S. Cl. ..... 162/261; 162/251; 209/271; 209/397; 210/498; 241/46.17; 241/69

[58] Field of Search ..... 162/251, 55, 261; 241/46.17, 69; 209/271, 397; 210/498, 173, 174

[56] References Cited

U.S. PATENT DOCUMENTS

| | | | |
|---|---|---|---|
| 4,276,159 | 6/1981 | Lehman | 209/397 |
| 4,473,466 | 9/1984 | Schmidt et al. | 209/397 |
| 4,571,298 | 2/1986 | Holz | 210/498 |
| 4,812,229 | 3/1989 | Tra | 209/397 |

FOREIGN PATENT DOCUMENTS

| | | | |
|---|---|---|---|
| 0079811 | 10/1982 | European Pat. Off. . | |
| 79811 | 5/1983 | European Pat. Off. | 162/251 |
| 143894 | 1/1902 | Germany | 210/498 |
| 659111 | 10/1951 | United Kingdom . | |
| WO9010110 | 9/1990 | WIPO . | |

*Primary Examiner*—Karen M. Hastings
*Attorney, Agent, or Firm*—Price, Gess & Ubell

[57] ABSTRACT

A strainer for paper making capable of accomplishing maceration and screening of a paper feedstock with high efficiency and being simplified in structure and manufacturing. The strainer is arranged in proximity to a rotor and formed with a plurality of recesses on a surface thereof opposite to the rotor. Also, a screening apparatus for paper making which uses such a strainer is disclosed.

6 Claims, 4 Drawing Sheets

STRAINER FOR PAPER MAKING

BACKGROUND OF THE INVENTION

This invention relates to a screening apparatus for macerating and screening a paper feedstock in a paper manufacturing process, and more particularly to a strainer suitable for use in a pulper for macerating a paper feedstock or the like.

In general, a pulper for paper making or the like includes a strainer for screening a paper feedstock of good quality macerated through a rotor rotating.

A strainer which has been conventionally used for this purpose is generally constructed as shown in FIG. 1. More particularly, a conventional strainer which is generally designated by reference numeral 100 in FIG. 1 includes a flat straining body or plate 102 formed into a disc-like shape and provided with a number of through-holes or apertures 104 functioning as straining apertures. The strainer 100 also includes a plurality of cutters 106 mounted on an upper surface of the straining plate 102 using fixing means 108 such as bolts or the like in a manner to be perpendicular to a direction of rotation of a rotor (not shown) arranged so as to rotate in proximity to the strainer 100. The strainer 100 thus constructed permits its maceration ability to be enhanced by cooperation of the cutters 106 with the rotor rotating.

Unfortunately, the conventional strainer constructed as described above has a lot of disadvantages.

One of the disadvantages encountered with the conventional strainer is that the cutters 106 account for a considerable part of the surface area of the straining plate 102, resulting in an area of distribution of the straining apertures 104 on the straining plate 102 being reduced.

Another disadvantage of the prior art is that the cutters 106 are arranged on the upper surface of the straining plate 102 in a manner to project therefrom, to thereby cause a gap between the rotor and the straining plate 102 to be increased, so that a screening effect exhibited by the straining apertures 104 of the straining plate 102 due to vortex resulting from rotation of the rotor may be reduced.

A further disadvantage of the prior art is that the length of a cutting edge formed at each of the cutters 106 is restricted.

Also, the conventional strainer has still another disadvantage that there is a possibility of causing the fixing means 108 such as bolts or the like for fixing the cutters 106 on the straining plate 102 to be loosened during the screening operation, leading,to removal of the cutters 106 from the straining plate 102.

In addition, the conventional strainer causes the number of parts required for forming the strainer 100 to be increased.

Yet another disadvantage encountered with the conventional strainer is that the manufacturing is highly troublesome and time-consuming because it is required to manufacture the individual cutters 106 and mount them on the straining plate 102 by means of bolts or the like.

SUMMARY OF THE INVENTION

The present invention has been made in view of the foregoing disadvantages of the prior art.

Accordingly, it is an object of the present invention to provide a strainer for paper making which is capable of accomplishing the maceration and screening of a paper feedstock with high efficiency.

It is another object of the present invention to provide a strainer for paper making which is capable of being significantly simplified in structure.

It is a further object of the present invention to provide a strainer for paper making which is capable of enhancing safety in the operation.

It is still another object of the present invention to provide a strainer for paper making which is capable of being readily and simply manufactured.

In accordance with one aspect of the present invention, a strainer for paper making arranged in proximity to a rotating rotor for screening a paper feedstock to be macerated is provided, wherein a plurality of recesses are formed on a surface of said strainer opposite to the rotor.

Such construction effectively prevents a decrease in area of distribution of the straining apertures and permits an edge of each of the recesses to function as a cutter. Also, the present invention constructed as described above permits micro-vortexes to occur in the recesses when the rotor passes above the recesses. Thus, it will be noted that the strainer of the present invention exhibits an excellent maceration function, as well as a satisfactory screening function.

The recesses may be formed into any suitable shape such as a circular shape or the like from the viewpoint manufacturing.

In a preferred embodiment of the present invention, the recesses may be formed into the same size. Alternatively, they may comprise a combination of recesses formed into sizes different from each other.

An edge of each of the recesses acting as a cutting edge may be formed into a desired length.

In a preferred embodiment of the present invention, the recesses may be arranged in a zigzag manner. Alternatively, they may be radially arranged.

In accordance with another aspect of the present invention, a screening apparatus for paper making for macerating and screening a paper feedstock is provided. The screening apparatus comprises a tank, a rotor rotatably arranged in the tank, and a strainer arranged in proximity to the rotor and formed with through-holes for passing an available fiber material therethrough in a manner to be distributed substantially all over a surface thereof. The strainer is formed on a surface thereof opposite to the rotor with a plurality of recesses, each of which has an edge functioning a cutter which cooperates with the rotor.

In a preferred embodiment of the present invention, the strainer is formed into a plate-like shape and arranged on an inner side of a bottom of the tank to partition an interior of the tank into an upper chamber and a lower chamber, and the rotor is arranged above the strainer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
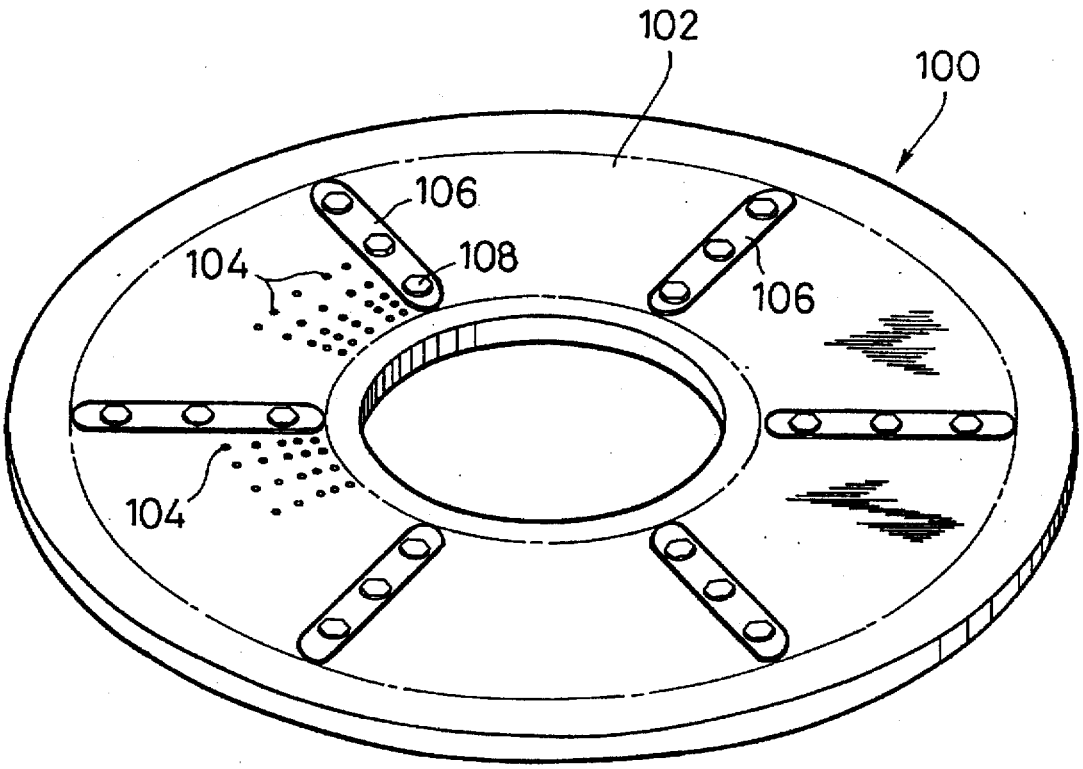
FIG. 1 PRIOR ART
FIG. 1 is a perspective view showing a conventional strainer.

Now, a screening apparatus and a strainer according to the present invention will be described hereinafter with reference to FIGS. 2 to 7, wherein like reference numerals designate like or corresponding parts throughout.

Figure 2:
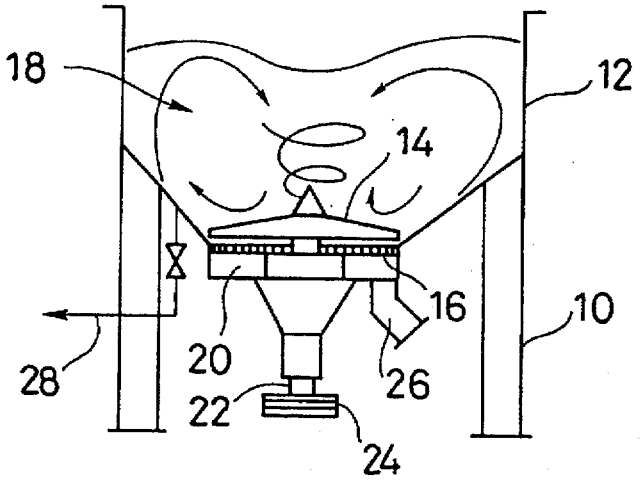
FIG. 2 is a schematic vertical sectional view showing an embodiment of a pulper or screening apparatus according to the present invention.

FIG. 2 generally shows an embodiment of a pulper or a screening apparatus according to the present invention therein. The pulper exemplified in FIG. 2 includes a leg or support section 10 and an upright tank 12 formed into a substantially cylindrical shape and supported on the leg section 10. The tank 12 is provided on an inner side of a bottom thereof with a rotor 14 in a rotatable manner, which functions to permit a paper feedstock incorporated into and mixed with water in the tank 12 to flow round. Below the rotor 14 in the tank 12 is provided a strainer 16 of a disc-like shape which is an embodiment of the present invention and acts to partition the interior of the tank 12 into an upper treating chamber 18 and a lower treating chamber 20 therethrough in the vertical direction. The strainer 16 is fixedly arranged in the tank 12. The rotor 14 is positioned in proximity to an upper surface of the strainer 16 and mounted on an upper end of a drive shaft 22 downward extending through the tank 12 to the exterior of the tank. The drive shaft 22 is mounted on a lower end thereof with a transmission member 24 such as a pulley or the like, which is then connected to a motor (not shown) directly or through a suitable transmission mechanism. Also, the tank 12 is provided on the bottom thereof with an outlet passage 26 for feeding an available fiber material which is passed through the strainer 16 from the lower treating chamber 20 therethrough to the exterior of the tank and a discharge passage 28 for discharging any foreign matter included in the paper feedstock and separated by maceration in the pulper from the upper treating chamber 18 therethrough to the exterior of the tank.

Figure 3:
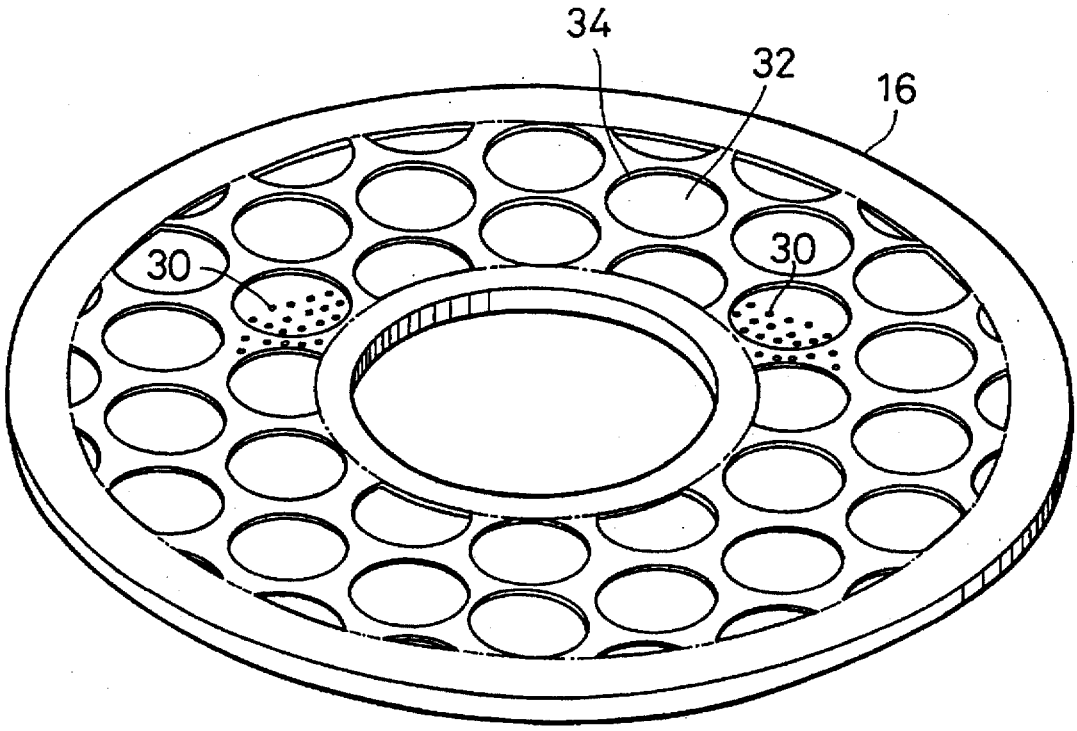
FIG. 3 is a perspective view showing an embodiment of a strainer according to the present invention.
Figure 4:
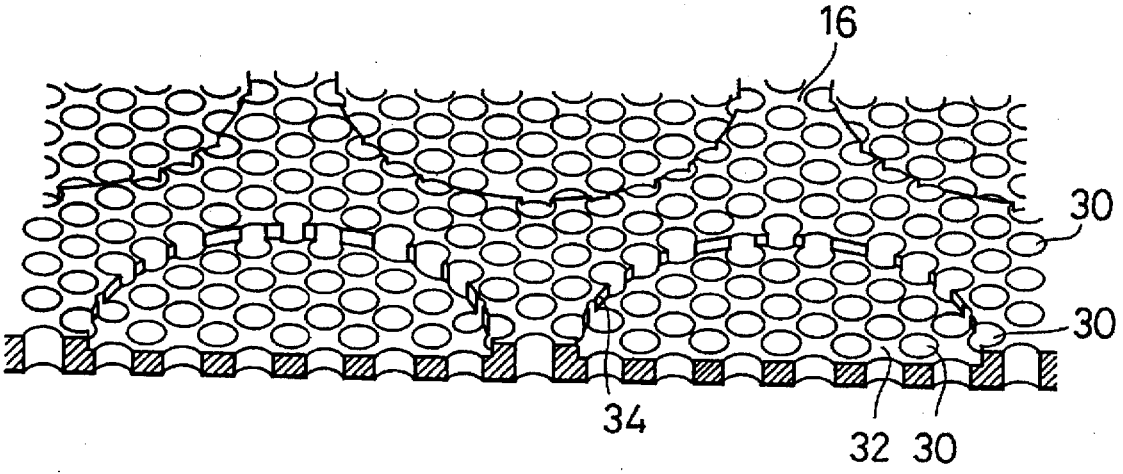
FIG. 4 is a fragmentary enlarged perspective sectional view of the strainer shown in FIG. 3.

The strainer 16 may be constructed in such a manner as shown in FIG. 3. More particularly, the strainer 16 is generally formed into an annular shape so as to have a hole provided at a central portion thereof, through which a drive shaft of the rotor 14 is inserted. The strainer 16 is formed with a number of small through-holes or apertures 30 in a manner to be distributed all over a surface thereof. The apertures thus formed each serve as a straining aperture. Also, the strainer 16 is provided on an upper surface thereof with a plurality of circular recesses 32 which form curvilinear cutting edges, which, in the embodiment shown in FIG. 3 are arranged in a zigzag manner. The recesses 32 each have an upper edge 34 defined on the same level as the upper surface of the strainer 16 and opposite to the rotor 14. The upper edge 34 each functions as a cutting edge, which cooperates with the rotor 14 as described hereinafter. The straining apertures 30, as shown in FIG. 4, are formed not only on the outside of the recesses 32 but on the inside thereof. Also, the straining aperture 30 may be formed so as to extend from a portion of the strainer at which the recess 32 is formed to a portion of the strainer 16 at which the recess 32 is not formed. This results in a part of the cutting edge of the recess 32 being discontinued, however, such discontinuation does not adversely affect the strainer of the illustrated embodiment.

The strainer 16 is formed by subjecting a perforated plate to cutting to form the recesses 32, cutting it into a donut-like shape, and fitting the donut-like plate on a frame through inner and outer peripheries thereof to fix it integral with the frame. In this instance, the recesses 32 laid across the inner and outer peripheries of the strainer, as shown in FIG. 3, partially wane; however, this does not adversely affect the strainer of the illustrated embodiment.

Figure 5:
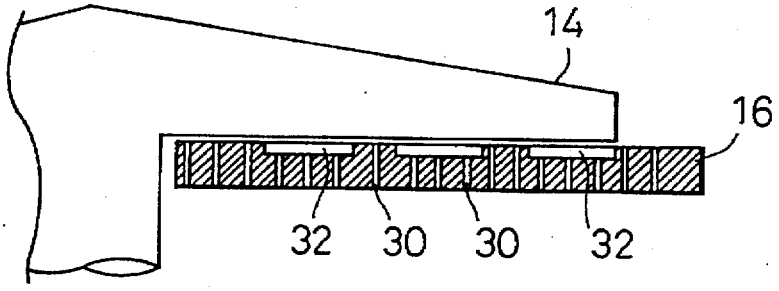
FIG. 5 is a vertical sectional view of the strainer of FIG. 3 showing the relationship between the strainer and a rotor.
Figure 6:
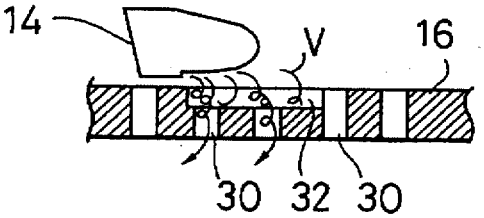
FIG. 6 is a fragmentary vertical sectional view of the strainer of FIG. 3 showing the flow of a material in a recess of the strainer.

In the pulper of FIG. 2 which is so constructed that the thus-formed strainer 16 is fixed on the inner surface of the bottom of the tank 12, as shown in FIG. 5, the rotor 14 and strainer 16 can be arranged in such a manner that the lower end of the rotor 14 and the upper surface of the strainer 16 are positioned in proximity to each other. Therefore, when the rotor 14 is driven by means of the motor (not shown), the paper feedstock in the tank 12 is caused to flow round due to rotation of the rotor 14. Also, this results in micro-vortexes V occurring in each of the recesses 32 when the rotor 14 passes above the recess, as shown in FIG. 6. The so-produced micro-vortexes V promote maceration of a paper feedstock and the screening of the paper feedstock through the straining apertures 30.

Figure 7:
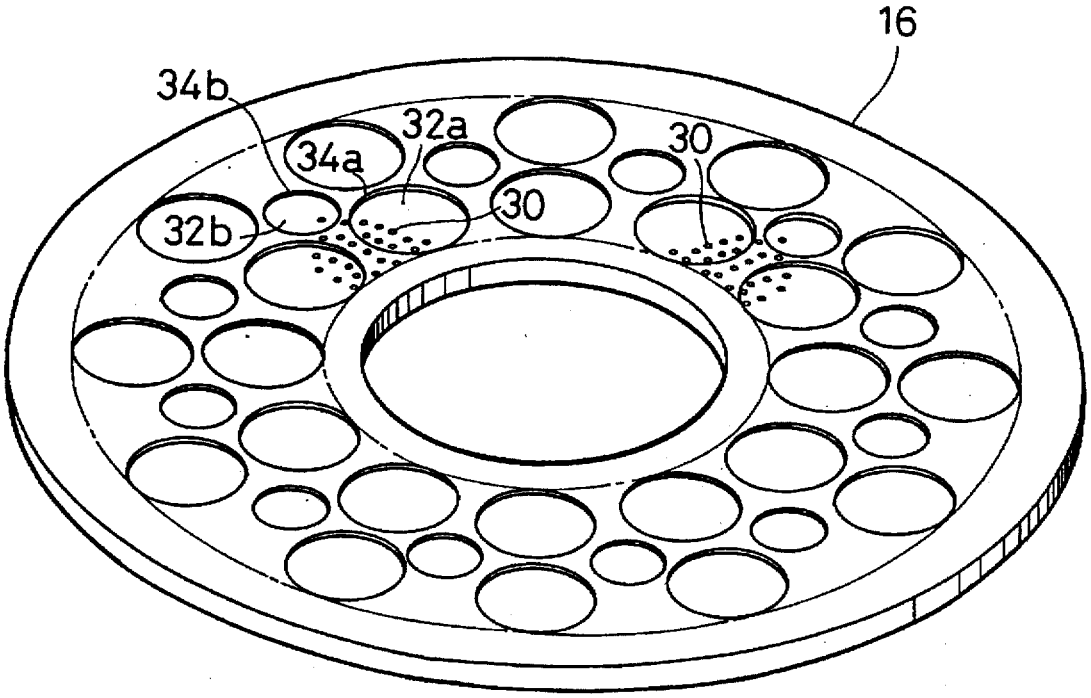
FIG. 7 is a perspective view showing another embodiment of a strainer according to the present invention.

FIG. 7 shows another embodiment of a strainer according to the present invention. A strainer of the illustrated embodiment generally designated at reference numeral 16 is generally formed into an annular shape and provided with a plurality of small through-holes or apertures 30 functioning as straining apertures. Also, the strainer 16 is also formed with a plurality of first circular recesses **32*a* of a large size and a plurality of second circular recesses 32*b* of a small size. The first recesses 32*a* are radially arranged and the second recesses 32*b* each are arranged in a manner to be surrounded by four such first recesses 32*a* adjacent to each other. The first and second recesses 32*a* and 32*b* have Upper edges 34*a* and 34*b* defined so as to be flush with an upper surface of the strainer 16**, respectively, so that the upper edges each may function as a cutting edge.

The remaining part of the strainer 16 shown in FIG. 7 may be constructed in substantially the same manner as that shown in FIG. 2.

Thus, the strainer 16 of the illustrated embodiment constructed as described above may exhibit substantially the same functions as the embodiment described above.

As will be readily noted from the above, in the present invention, the recesses arranged on the strainer so as to provide the cutting edges may be formed into the same configuration and size. Alternatively, they may be formed into different configurations and/or sizes or they may comprise a combination of recesses formed into configurations and/or sizes different from each other. The size, number and configuration of the recesses may be suitably selected to permit the cutting edge defined by the upper edge of each of the recesses to be formed into a desired length. The recesses each are preferably formed into a circular shape from the viewpoint of manufacturing of the strainer. For example, the recesses may be formed into a diameter of about 20 to 150 mm and a depth of about 0.5 to 5.0 mm. Alternatively, the recesses may be formed into any suitable shape such as an elliptic shape, a rectangular shape, a triangular shape or the like other than a circular shape.

The strainer of the present invention may be manufactured according to any suitable process other than the above-described process. For example, it may be manufactured by subjecting a single plate material to cutting to form the recesses and then forming the plate with the straining apertures. Alternatively, it may be produced by superposing a plate formed with through-holes corresponding to the recesses and a blank plate on each other and then forming the plates with the straining apertures.

As can be seen from the foregoing, the strainer of the present invention for paper making which is arranged in the vicinity of a rotor for screening a paper feedstock macerated is formed with a plurality of the recesses on the surface thereof opposite to the rotor, to thereby eliminate the mounting of cutters on the strainer as required in the prior art, resulting in effectively preventing a decrease in area of the straining apertures. Also, the strainer of the present invention permits the cutting edges to be formed into a desired length. Thus, the strainer of the present invention can exhibit a satisfactory maceration function and an excellent screening or straining function. In addition, the present invention permits the number of parts required for forming the strainer to be significantly reduced and the manufacturing to be readily carried out.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

I claim:

1. A screening apparatus for paper making which macerates and screens a paper feedstock, comprising:

a tank;

a rotor rotatably arranged in said tank; and a unitary strainer arranged in proximity to said rotor and formed with through-holes through which an available fiber material is passed in a manner to be distributed substantially all over a surface thereof;

said strainer being formed on a surface thereof opposite to said rotor with a plurality of recesses;

said recesses each having a discontinuous currilinear edge functioning as a cutter, which cooperates with said rotor.

2. A screening apparatus as defined in claim 1, wherein said strainer is formed into a plate-like shape and arranged on an inner side of a bottom of said tank to partition an interior of said tank into an upper chamber and a lower chamber; and said rotor is arranged above said strainer.

3. A screening apparatus as defined in claim 2, wherein said recesses comprise a combination of recesses formed into sizes different from each other.

4. A screening apparatus as defined in claim 2, wherein said recesses are arranged in a zigzag manner.

5. A screening apparatus as defined in claim 2, wherein said recesses are radially arranged.

6. A screening apparatus as defined in claim 2, wherein said through-holes are formed at said recesses as well as outside said recesses.

* * * * *